US011397397B1

(12) United States Patent
Tashiro

(10) Patent No.: US 11,397,397 B1
(45) Date of Patent: Jul. 26, 2022

(54) IMAGE FORMING APPARATUS

(71) Applicant: TOSHIBA TEC KABUSHIKI KAISHA, Tokyo (JP)

(72) Inventor: Hiroki Tashiro, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/367,840

(22) Filed: Jul. 6, 2021

(51) Int. Cl.
*G03G 15/00* (2006.01)
*G03G 15/16* (2006.01)

(52) U.S. Cl.
CPC ..... *G03G 15/5037* (2013.01); *G03G 15/16* (2013.01); *G03G 15/55* (2013.01)

(58) Field of Classification Search
CPC ..... G03G 15/5037; G03G 15/55
See application file for complete search history.

(56) References Cited

U.S. PATENT DOCUMENTS

2006/0104649 A1* 5/2006 Nagamochi ..... G03G 15/5037 399/26
2012/0183310 A1* 7/2012 Asano ..... G03G 21/1671 399/48
2018/0150013 A1* 5/2018 Nii ..... G03G 15/55

FOREIGN PATENT DOCUMENTS

| | | |
|---|---|---|
| JP | 10-78712 | 3/1998 |
| JP | 2008-122440 | 5/2008 |
| JP | 2009-276444 | 11/2009 |
| JP | 2015-049432 | 3/2015 |

* cited by examiner

*Primary Examiner* — Carla J Therrien
(74) *Attorney, Agent, or Firm* — Amin, Turocy & Watson, LLP

(57) ABSTRACT

An image forming apparatus includes an image carrier, a charging unit, an exposure unit, a developing unit, a transfer device, a sensor, and a processor. The processor compares a surface potential difference between a first surface potential and a second surface potential of the image carrier to a threshold to detect that a surface potential difference exceeding the threshold is generated in the image carrier in a state where the supply of the developer from the developing unit to the image carrier is inhibited, the first surface potential being a surface potential of the image carrier to which the transfer bias measured by the sensor is not applied, and the second surface potential being a surface potential of the image carrier to which the transfer bias is applied.

20 Claims, 12 Drawing Sheets

IMAGE FORMING APPARATUS

FIELD

Embodiments described herein relate generally to an image forming apparatus and methods of operating an image forming apparatus.

BACKGROUND

For example, an image forming apparatus using an electrophotographic process includes a photoreceptor, a charging unit, an exposure unit, a developing unit, a transfer mechanism, and a fixing unit. In the image forming apparatus, a developer image is formed on a surface of the photoreceptor as an image carrier by the charging unit, the exposure unit, and the developing unit. In the image forming apparatus, the photoreceptor having an outer circumferential surface as the image carrier rotates. The charging unit uniformly charges the outer circumferential surface of the photoreceptor. The exposure unit exposes the uniformly charged surface of the photoreceptor to form an electrostatic latent image. The developing unit develops the electrostatic latent image formed on the surface of the photoreceptor with a developer to form a developer image.

The transfer mechanism transfers the developer image formed on the surface of the photoconductive drum to a medium such as an intermediate transfer belt. The transfer mechanism applies a transfer bias to the photoreceptor through the intermediate transfer belt to transfer the developer image on the surface of the photoconductive drum to the intermediate transfer belt. In this image forming apparatus, the photoreceptor may exhibit the memory effect for the transfer bias due to deterioration over time. If there is a surface potential difference due to deterioration over time during the application of the transfer bias, density unevenness may occur in the photoreceptor. In an image forming apparatus in the related art, if the density unevenness caused by deterioration over time increases, there is a problem in that a user needs to request a service person for maintenance such as replacement of the photoreceptor.

DETAILED DESCRIPTION

In general, according to one embodiment, there is provided an image forming apparatus including an image carrier, a charging unit, an exposure unit, a developing unit, a transfer device, a sensor, and a processor. The charging unit is configured to charge the image carrier. The exposure unit is configured to form an electrostatic latent image on the image carrier that is charged by the charging unit. The developing unit is configured to supply a developer to the image carrier. The transfer device is configured to apply a transfer bias for transferring a developer image to a medium, the developer image being formed by developing the electrostatic latent image on the image carrier with the developing unit. The sensor is configured to measure a surface potential on the image carrier. The processor is configured to compare a surface potential difference between a first surface potential and a second surface potential of the image carrier to a threshold to detect that a surface potential difference exceeding the threshold is generated in the image carrier in a state where the supply of the developer from the developing unit to the image carrier is inhibited, the first surface potential being a surface potential of the image carrier to which the transfer bias measured by the sensor is not applied, and the second surface potential being a surface potential of the image carrier to which the transfer bias is applied. According to one embodiment, method for operating an image forming apparatus involving charging an image carrier; forming an electrostatic latent image on the image carrier; supplying a developer to the image carrier; applying a transfer bias to transfer a developer image from the image carrier to a medium, the developer image being formed by developing the electrostatic latent image on the image carrier; measuring a surface potential on the image carrier; and comparing a surface potential difference between a first surface potential and a second surface potential of the image carrier to a threshold to detect that a surface potential difference exceeding the threshold is generated in the image carrier in a state where the supply of the developer from a developing component to the image carrier is inhibited, the first surface potential being a surface potential of the image carrier to which the transfer bias measured by the sensor is not applied, and the second surface potential being a surface potential of the image carrier to which the transfer bias is applied.

Figure 1:
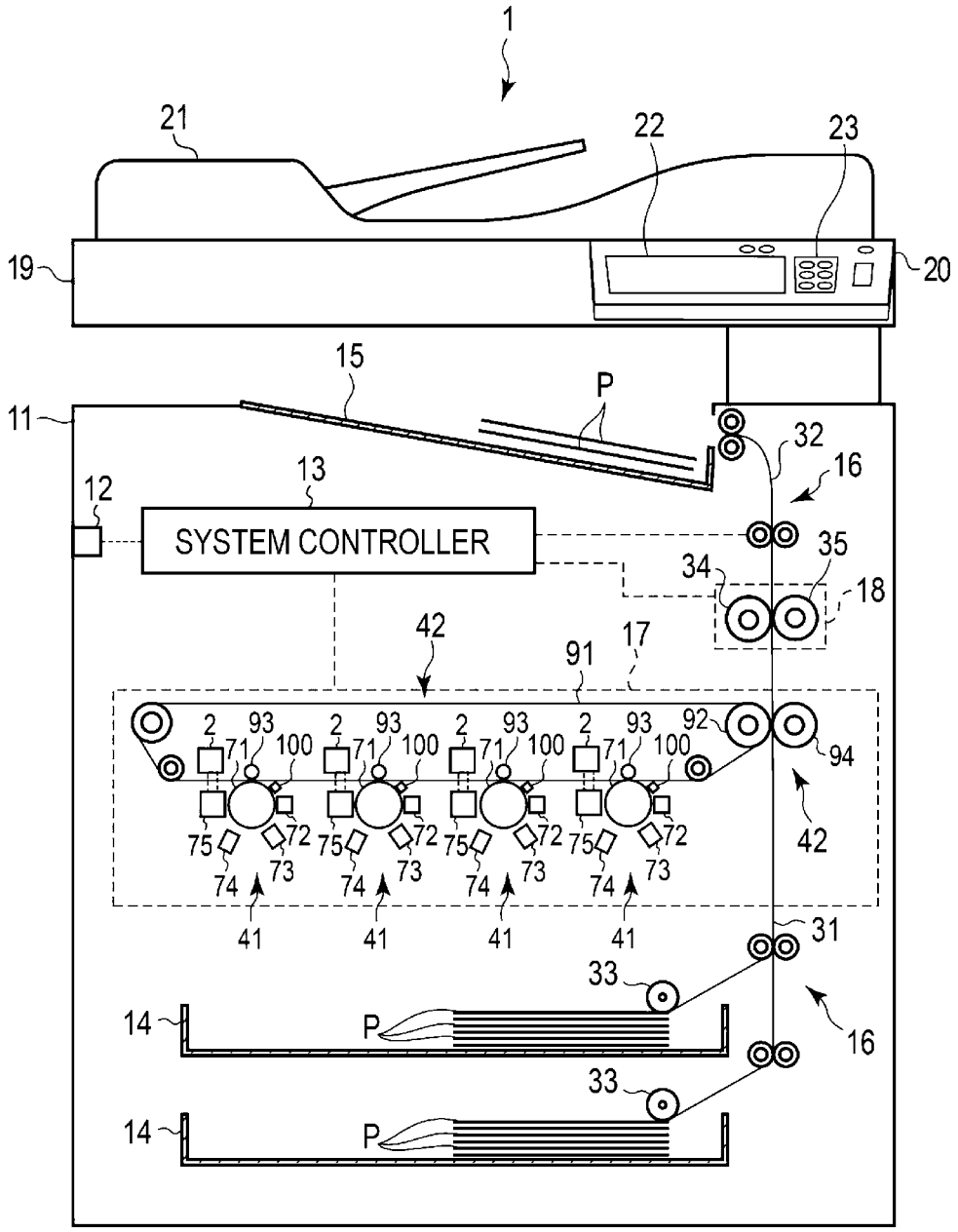
FIG. 1 is a schematic diagram illustrating a schematic configuration of an image forming apparatus according to an embodiment.
Figure 2:
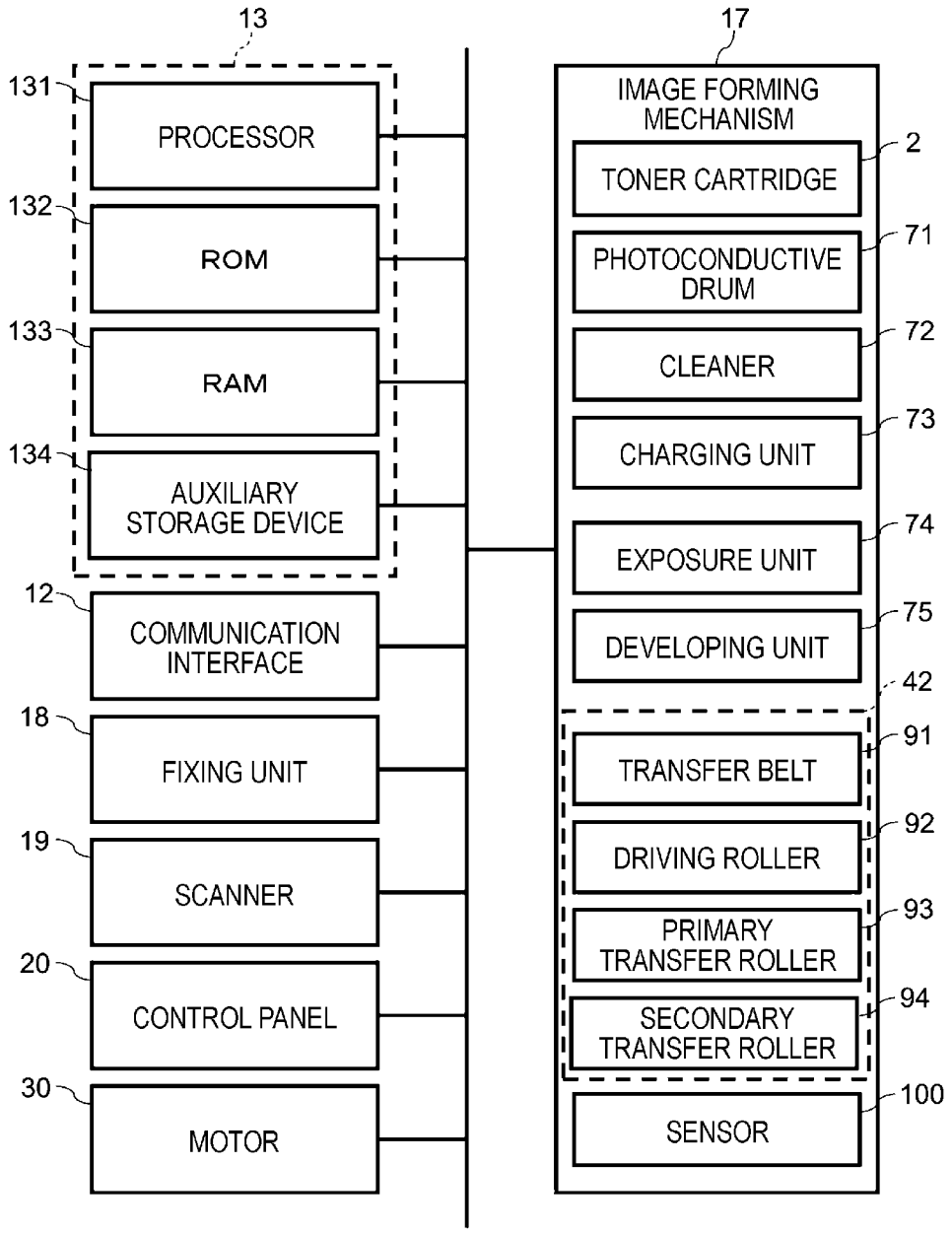
FIG. 2 is a block diagram illustrating a configuration example of a control system.

FIG. 1 is a schematic diagram illustrating a schematic configuration of an image forming apparatus 1 according to an embodiment.

The image forming apparatus 1 forms an image on a printing medium P through an electrophotographic process. The image forming apparatus 1 forms an image on the printing medium P by developing an image with toner. As the toner, a monochrome toner may be used or a plurality of color toners such as yellow, magenta, cyan, or black may be used. FIG. 1 illustrates a multi-function peripheral using four color toners as an example of the image forming apparatus 1.

As illustrated in FIG. 1, the image forming apparatus 1 includes a housing 11, a communication interface 12, a controller 13, a plurality of paper trays 14, a paper discharge tray 15, a conveyance mechanism 16, an image forming mechanism 17, a fixing unit 18, a scanner 19, and a control panel 20.

The housing 11 is a main body of the image forming apparatus 1. The housing 11 accommodates, for example, the communication interface 12, the controller 13, the paper trays 14, the conveyance mechanism 16, the image forming mechanism 17, and the fixing unit 18. A part of an upper surface of the housing 11 functions as the paper discharge tray 15.

The communication interface 12 is an interface for communication with another apparatus to which the image forming apparatus is connected via the network. The communication interface 12 is used for communication with an external apparatus. The external apparatus is, for example, a center as a management apparatus. The communication interface 12 is configured with, for example, a LAN connector. The communication interface 12 may execute wireless communication with another apparatus in accordance with a standard such as Bluetooth (registered trademark) or Wi-fi (registered trademark).

The controller 13 executes controls, data processing, and the like on the respective units of the image forming apparatus 1. For example, the controller 13 is a computer including a processor, a memory, and various interfaces. The controller 13 executes controls, data processing, and the like on the respective units of the image forming apparatus 1 by the processor executing programs stored in the memory. The controller 13 is connected to the respective units in the housing 11 via various internal interfaces. For example, the controller 13 is connected to the communication interface 12, the paper discharge tray 15, the conveyance mechanism 16, the image forming mechanism 17, the fixing unit 18, the scanner 19, and the like.

The controller 13 generates a print job based on data acquired from an external apparatus via the communication interface 12. The print job includes image data representing an image that is formed on the printing medium P. The image data may be data for forming an image on a single printing medium P or may be data for forming an image on a plurality of printing media P. The print job may include information representing whether the printing is color printing or monochrome printing.

The controller 13 includes an engine controller for controlling operations of the conveyance mechanism 16, the image forming mechanism 17, and the fixing unit 18. For example, the controller 13 controls the conveyance mechanism 16 to convey the printing medium P. The controller 13 controls the image forming mechanism 17 to form a developer image and controls transfer of the developer image to the medium P. The controller 13 controls the fixing unit 18 to fix the developer image to the printing medium P. The controller 13 controls the operation of the conveyance mechanism 16, the image forming mechanism 17, and the fixing unit 18 such that an image of image data in a print job is formed on the printing medium P.

The image forming apparatus 1 may be configured to include an engine controller separately from the controller 13. For example, in the image forming apparatus 1, an engine controller that controls at least one of the conveyance mechanism 16, the image forming mechanism 17, the fixing unit 18, and the like may be provided separately from the controller 13. The engine controller provided separately from the controller 13 may acquire information required for the control from the controller 13.

The paper trays 14 are cassettes accommodating the printing media P, respectively. The paper tray 14 is configured to supply the printing medium P from the outside of the housing 11. For example, the paper tray 14 is configured to be drawn out from the housing 11.

The conveyance mechanism 16 is a mechanism that conveys the printing medium P in the image forming apparatus 1. As illustrated in FIG. 1, the conveyance mechanism 16 includes a plurality of conveyance paths. The conveyance mechanism 16 includes a paper feed conveyance path 31 and a paper discharge conveyance path 32.

The paper feed conveyance path 31 and the paper discharge conveyance path 32 are configured with a plurality of rollers and a plurality of guides. The rollers rotate with power transmitted from a driving mechanism to convey the printing medium P. The guides control a conveying direction of the printing medium P conveyed by the rollers.

The paper feed conveyance path 31 picks up the printing medium P from the paper tray 14 and supplies the picked printing medium P to the image forming mechanism 17. The paper feed conveyance path 31 includes a plurality of pickup rollers 33 corresponding to the paper trays 14, respectively. Each of the pickup rollers 33 picks up the printing medium P of the paper tray 14 to the paper feed conveyance path 31.

The paper discharge conveyance path 32 is a conveyance path through which the printing medium P on which an image is formed by the image forming mechanism 17 is discharged from the housing 11. The paper discharge conveyance path 32 discharges the printing medium P to the paper discharge tray 15. The paper discharge tray 15 is a tray that receives the printing medium P discharged from the image forming apparatus 1.

The image forming mechanism 17 has a configuration for forming an image on the printing medium P. The details of the image forming mechanism 17 will be described below.

The fixing unit 18 includes a heating roller 34 and a pressurization roller 35. The fixing unit 18 heats the printing medium P conveyed through the paper discharge conveyance path 32 to a predetermined temperature with the heating roller 34. The fixing unit 18 further pressurizes the printing medium P heated by the heating roller 34 with the pressurization roller 35. The fixing unit 18 heats and pressurizes the printing medium P to fix an image (developer image) on the printing medium P to the printing medium P.

The scanner 19 reads a document and converts the read image into image data. The scanner 19 is provided in an upper portion of the housing 11. The scanner 19 includes an automatic document feeder 21. The scanner 19 reads an image of a document conveyed by the automatic document feeder 21.

The control panel 20 includes a touch panel 22, a keyboard 23, and the like. In the touch panel 22, for example, a display such as a liquid crystal display or an organic EL display and a touch sensor that detects a touch input are laminated. The display including the touch panel 22 is a display device of the image forming apparatus 1.

The keyboard 23 includes various keys for allowing a user to operate the image forming apparatus 1. For example, the keyboard 23 includes a numeric keypad, a power key, a paper feed key, a function key, and the like. Each of the keys will also be referred to as "button". The touch panel 22 and the keyboard 23 are input devices of the image forming apparatus 1.

Next, the image forming mechanism 17 will be described.

As illustrated in FIG. 1, the image forming mechanism 17 includes a plurality of image forming stations 41 and a transfer mechanism 42. Each of the image forming stations 41 forms a toner image. Each of the image forming stations 41 is provided for each type of toner. For example, the image forming stations 41 correspond to the respective color toners such as yellow, magenta, cyan, and black in this order from the left side in FIG. 1, respectively. The image forming stations 41 include toner cartridges 2 containing corresponding color toners, respectively. FIG. 1 illustrates the image forming apparatus 1 including four image forming stations 41 corresponding to four color toners of yellow, magenta, cyan, and black.

Next, the image forming stations 41 will be described.

Each of the image forming stations 41 includes a photoconductive drum 71, a cleaner 72, a charging unit 73, an exposure unit 74, and a developing unit 75.

The photoconductive drum 71 includes: a cylindrical drum; and a photosensitive layer that is formed on an outer circumferential surface of the drum. The photoconductive drum 71 is a photoreceptor. The outer circumferential surface of the photoconductive drum 71 is an image carrier. The photoconductive drum 71 rotates at a fixed speed with power transmitted from the driving mechanism.

The cleaner 72 includes a blade in contact with the surface of the photoconductive drum 71. The cleaner 72 removes toner remaining on the surface of the photoconductive drum 71 using the blade.

The charging unit 73 uniformly charges a surface of the photoconductive drum 71. The charging unit 73 will also be referred to as "electrostatic charger". For example, the charging unit 73 applies a grid bias voltage output from a grid electrode to the photoconductive drum 71 such that the photoconductive drum 71 is charged with uniform negative potential.

The exposure unit 74 includes a plurality of light emitting elements. The light emitting element is, for example, a laser diode (LD), a light emitting diode (LED), or an organic EL (OLED). The light emitting elements are arranged in a main scanning direction that is a direction parallel to a rotation axis of the photoconductive drum 71. Each of the light emitting elements is configured to irradiate one point on the photoconductive drum 71 with light.

The exposure unit 74 forms an electrostatic latent image corresponding to one line on the photoconductive drum 71 by irradiating the charged surface of the photoconductive drum 71 with light from the light emitting elements arranged in the main scanning direction. Further, the exposure unit 74 forms an electrostatic latent image corresponding to a plurality of lines by continuously irradiating the rotating photoconductive drum 71 with light.

The developing unit 75 attaches the toner to the photoconductive drum 71. The developing unit 75 contains a developer containing a toner and a carrier. The developing unit 75 stirs the toner and the carrier supplied from the toner cartridge 2 with an agitating mechanism. The developing unit 75 supplies the toner to the photoconductive drum 71 from a developing roller to which the developer containing the toner and the carrier agitated by the agitating mechanism is attached. The developing unit 75 develops the electrostatic latent image on the photoconductive drum 71 with the toner by supplying the toner to the photoconductive drum 71. The photoconductive drum 71 holds the toner image (developer image) developed with the toner by the developing unit 75. The photoconductive drum 71 rotates to transfer the toner image to a transfer position of a transfer belt 91.

The transfer mechanism (transfer device) 42 transfers the toner image formed on the surface of the photoconductive drum 71 to the printing medium P. As illustrated in FIG. 1, the transfer mechanism 42 includes the transfer belt 91, a driving roller 92, a plurality of primary transfer rollers 93, and a secondary transfer roller 94.

The transfer belt 91 is a medium to which the toner image formed on the surface of the photoconductive drum 71 of each of the image forming stations 41 is transferred. The transfer belt 91 is an intermediate transfer medium that holds the image to be transferred to the printing medium P. In the configuration example illustrated in FIG. 1, the transfer belt 91 is an endless belt that is wound around the driving roller 92 and a plurality of winding rollers. A back surface of the transfer belt 91 as an inner surface comes into contact with the driving roller 92 and the winding rollers. A front surface of the transfer belt 91 as an outer surface faces the photoconductive drum 71 of each of the image forming stations 41.

The driving roller 92 rotates with power transmitted from the driving mechanism. The driving roller 92 rotates to convey the transfer belt 91. In the configuration example illustrated in FIG. 1, the driving roller 92 rotates counterclockwise. Due to the rotation of the driving roller 92, the transfer belt 91 as the endless belt is conveyed to rotate counterclockwise. The winding rollers are configured to be freely rotatable. The winding rollers rotate according to the movement of the transfer belt 91 by the driving roller 92.

The primary transfer rollers 93 are provided for each of the image forming stations 41. Each of the primary transfer rollers 93 is provided to face the photoconductive drum 71 of the corresponding image forming station 41. Each of the primary transfer rollers 93 is provided at a position facing the photoconductive drum 71 of the corresponding image forming station 41 with the transfer belt 91 interposed therebetween.

The primary transfer roller 93 comes into contact with an inner circumferential surface of the transfer belt 91. The primary transfer roller 93 presses the transfer belt 91 against the photoconductive drum 71 from the inner circumferential surface side. The surface (outer circumferential surface) of the transfer belt 91 pressed by the primary transfer roller 93 abuts against the photoconductive drum 71. If the image (toner image) is transferred from the photoconductive drum 71, the primary transfer roller 93 applies the transfer bias to the photoconductive drum 71 through the transfer belt 91.

The toner image is transferred from the photoconductive drum 71 to the transfer belt 91 by the transfer bias applied from the primary transfer roller 93.

The secondary transfer roller 94 is provided at a position facing the driving roller 92. The inner circumferential surface of the secondary transfer roller 94 comes into contact with the surface of the conveyed transfer belt 91 due to the driving roller 92. The secondary transfer roller 94 presses the transfer belt 91 against the driving roller 92 side. The surface of the transfer belt 91 interposed between the driving roller 92 and the secondary transfer roller 94 adheres closely to the secondary transfer roller 94. A transfer nip is formed at a place where the surface of the transfer belt 91 and the secondary transfer roller 94 adhere closely to each other.

The secondary transfer roller 94 is conveyed in a state where the printing medium P supplied from the paper feed conveyance path 31 is interposed between the secondary transfer roller 94 and the transfer belt 91. The printing medium P passes through the transfer nip. The secondary transfer roller 94 presses the printing medium P passed through the transfer nip against the surface of the transfer belt 91. If the toner image of the transfer belt 91 is transferred to the printing medium P in the transfer nip, the secondary transfer roller 94 applies the transfer bias to the transfer belt 91 through the printing medium P. The toner image on the transfer belt 91 is transferred to the printing medium P by the transfer bias.

At a position where the surface of the transfer belt 91 is in contact with the surface of the photoconductive drum 71, the transfer mechanism 42 transfers the toner image on the surface of the photoconductive drum 71 to the surface of the transfer belt 91. The transfer mechanism 42 transfers the toner image on the photoconductive drum 71 to the transfer belt 91 abutting against the photoconductive drum 71 due to the transfer bias applied from the primary transfer roller. If the image forming stations 41 are provided, the transfer mechanism 42 transfers the toner images to the transfer belt 91 from the photoconductive drums 71 of the image forming stations 41.

The transfer mechanism 42 conveys the toner image transferred to the surface of the transfer belt 91 up to the transfer nip. The transfer mechanism 42 transfers the toner image transferred to the surface of the transfer belt 91 to the printing medium P present in the transfer nip due to the transfer bias applied from the secondary transfer roller. The transfer belt 91 is an example of the image carrier that holds the toner image transferred to the printing medium P.

In the image forming mechanism 17, each of the image forming stations 41 includes a sensor 100 that measures a potential of the surface (surface potential) of the photoconductive drum. The sensor 100 measures the surface potential of the photoconductive drum 71. In order to calculate a first surface potential described below, the sensor 100 measures the surface potential of the photoconductive drum 71 to which the transfer bias is not applied from the primary transfer roller 93. In order to calculate a second surface potential described below, the sensor 100 measures the surface potential of the photoconductive drum 71 to which the transfer bias is applied from the primary transfer roller.

Next, a configuration of a control system in the image forming apparatus 1 will be described.

Figure 3:
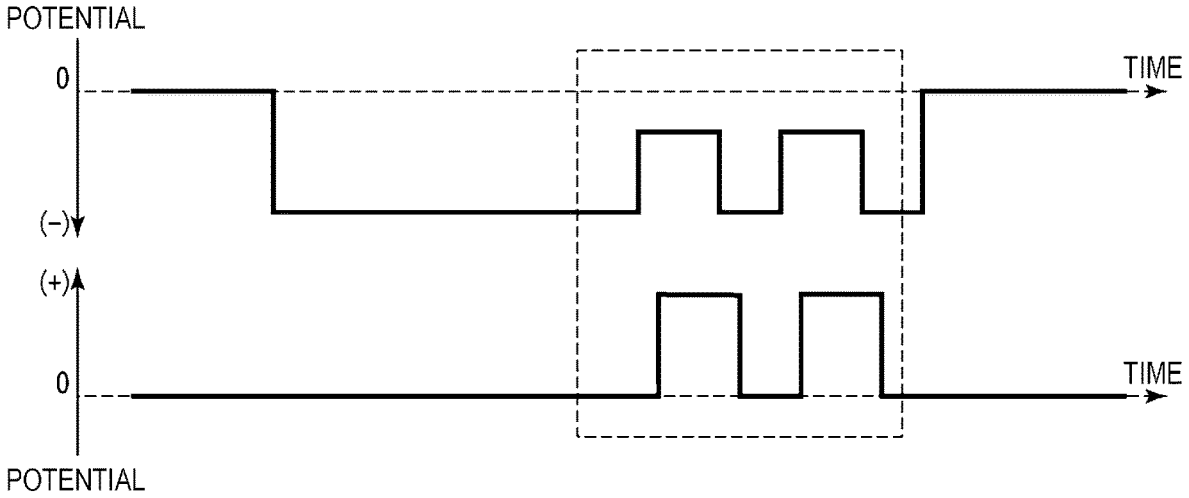
FIG. 3 is a diagram illustrating a relationship between a surface potential of a photoconductive drum and an output of a transfer bias.

FIG. 3 is a block diagram illustrating the configuration example of the control system in the image forming apparatus 1.

As illustrated in FIG. 3, in the image forming apparatus 1, the communication interface 12, the image forming mechanism 17, the fixing unit 18, the scanner 19, the control panel 20, a motor 30, and the like are connected to the controller 13.

The controller 13 includes a processor 131, a read only memory (ROM) 132, a random-access memory (RAM) 133, and an auxiliary storage device 134. The controller 13 configures a computer with the processor 131, the ROM 132, the RAM 133, and the auxiliary storage device 134.

The processor 131 corresponds to a central part of the computer as the controller 13. The processor 131 controls the respective units of the image forming apparatus 1 in accordance with an operating system or an application program. The processor 131 is, for example, a central processing unit (CPU).

The ROM 132 and the RAM 133 correspond to a main memory of the computer as the controller 13. The ROM 132 is a nonvolatile memory area, and the RAM 133 is a volatile memory area. The ROM 132 stores an operating system or an application program. The ROM 132 stores control data required to execute a process for allowing the processor 131 to control the respective units. The RAM 133 is used as a work area where data is appropriately rewritten by the processor 131. The RAM 133 has a work area for storing, for example, image data.

The auxiliary storage device 134 corresponds to an auxiliary storage part of the computer as the controller 13. The auxiliary storage device 134 is configured with, for example, an electric erasable programmable read-only memory (EEPROM), a hard disk drive (HDD), or a solid state drive (SSD). The auxiliary storage device 134 stores data such as setting data used for allowing the processor 131 to execute various processes. The auxiliary storage device 134 stores data generated through the process executed by the processor 131. The auxiliary storage device 134 may store the application program.

The controller 13 is connected to the toner cartridge 2, the photoconductive drum 71, the cleaner 72, the charging unit 73, the exposure unit 74, and the developing unit 75 in each of the image forming stations 41. The controller 13 controls the toner cartridge 2, the photoconductive drum 71, the cleaner 72, the charging unit 73, the exposure unit 74, and the developing unit 75. For example, the controller 13 controls the charging unit 73 of each of the image forming stations 41 to start or stop charging. The controller 13 controls the exposure unit 74 of each of the image forming stations 41 to start or stop irradiation of laser light with which the photoconductive drum is irradiated. In addition, the controller 13 controls the developing unit 75 of the each of the image forming stations 41 to start or stop application of a developing bias.

The controller 13 is connected to the transfer belt 91, the driving roller 92, the primary transfer rollers 93, and the secondary transfer roller 94 in the transfer mechanism 42. The controller 13 is also connected to the fixing unit 18. For example, the controller 13 controls the start or stop of application of the transfer bias to the photoconductive drum 71 facing each of the primary transfer rollers 93. The controller 13 controls a value (applied value) of the transfer bias that is applied by the primary transfer roller 93. The controller 13 controls the start or stop of application of the transfer bias by the secondary transfer roller 94.

The motor 30 operates the respective units. The motor 30 is connected to the controller 13. The motor 30 operates in accordance with the control from the controller 13. The motor 30 includes, for example, a first motor, a second motor, and a third motor. The first motor as the motor 30 drives the conveyance mechanism 16. The second motor as the motor 30 rotates the photoconductive drum 71. The third motor as the motor 30 rotates the driving roller 92. A plurality of second motors are provided to correspond to the photoconductive drums 71 of the image forming stations 41, respectively. The motor 30 may include a motor other than the first, second, and third motors.

Next, the surface potential of the photoconductive drum 71 in the image forming apparatus 1 according to the embodiment will be described.

FIG. 3 is a diagram illustrating timings of charging, exposure, and transfer bias application for the photoconductive drum 71.

As illustrated in FIG. 3, the photoconductive drum 71 is charged by the charging unit 73. After the charging unit 73 chares the surface of the photoconductive drum, the exposure unit 74 projects an optical image to the uniformly charged surface of the photoconductive drum. An electrostatic latent image corresponding to the optical image is formed on the surface of the photoconductive drum 71 to which the optical image is projected from the exposure unit 74. After a predetermined time is elapsed from the start of the exposure from the exposure unit 74, the primary transfer roller 93 applies the transfer bias to the photoconductive drum 71. The transfer belt 91 interposed between the primary transfer roller 93 and the photoconductive drum 71 transfers the toner image to the surface abutting against the photoconductive drum 71 to which the transfer bias is applied.

FIGS. 4 to 7 are schematic diagrams illustrating the primary transfer roller 93, the photoconductive drum 71, and the exposure unit 74 in the image forming apparatus 1.

Figure 4:
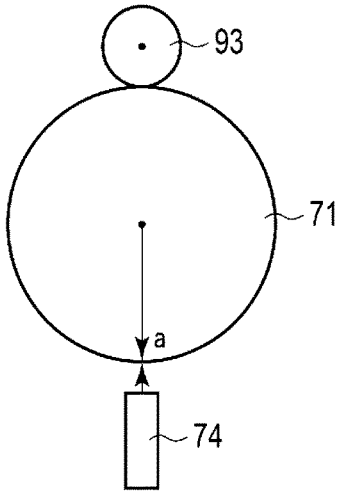
FIG. 4 is a diagram illustrating a relationship between the photoconductive drum, a charging unit, and a primary transfer roller.

In the examples illustrated in FIGS. 4 to 7, the photoconductive drum 71 rotates clockwise. FIG. 4 is a diagram illustrating a state where the exposure to the surface of the photoconductive drum 71 starts. In the image forming apparatus 1, the exposure unit 74 starts the exposure after the charging unit 73 charges the surface of the photoconductive drum 71. As illustrated in FIG. 4, a start position where the exposure to the surface of the photoconductive drum 71 starts will be referred to as "position a".

Figure 5:
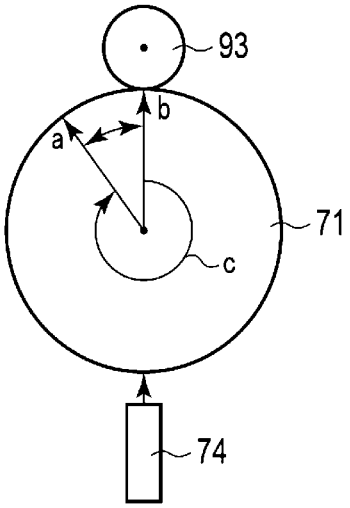
FIG. 5 is a diagram illustrating a relationship between the photoconductive drum, the charging unit, and the primary transfer roller.

FIG. 5 is a diagram illustrating a state where the transfer mechanism 42 starts the application of the transfer bias to the photoconductive drum 71 after a predetermined time is elapsed from the start of the exposure.

When the predetermined time is elapsed from the start of the exposure to the photoconductive drum 71, the transfer mechanism 42 applies the transfer bias to a place where the primary transfer roller 93 and the photoconductive drum 71 face each other. As illustrated in FIG. 5, a position where the application of the transfer bias starts in the photoconductive drum 71 will be referred to as "position b".

A fan-shaped region interposed between the position b and the position a in the photoconductive drum 71 is a region that is not yet exposed by the exposure unit 74. The fan-shaped region interposed between the position b and the position a passes through a position corresponding to the primary transfer roller 93 before being exposed by the exposure unit 74. In addition, a region c other than the fan-shaped region interposed between the position b and the position a does not apply the transfer bias until the position b subsequently passes the position facing the primary transfer roller 93. While the position b reaches the position facing the primary transfer roller 93, the surface of the photoconductive drum 71 is exposed by the exposure unit 74 before the primary transfer bias is applied.

Figure 6:
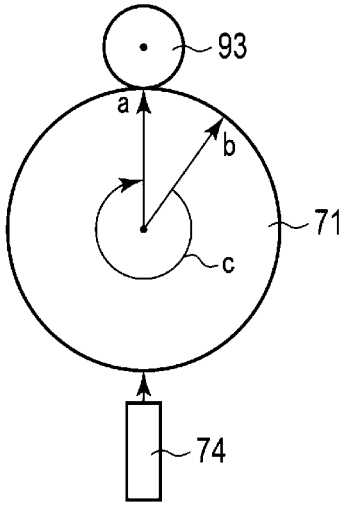
FIG. 6 is a diagram illustrating a relationship between the photoconductive drum, the charging unit, and the primary transfer roller.
Figure 7:
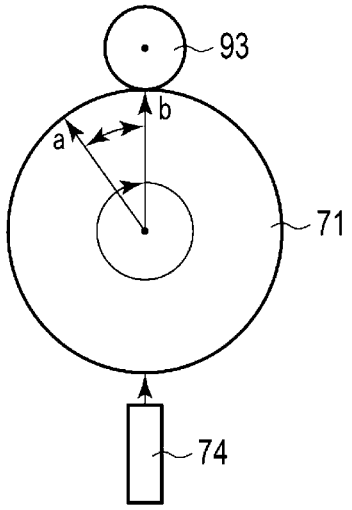
FIG. 7 is a diagram illustrating a relationship between the photoconductive drum, the charging unit, and the primary transfer roller.

FIG. 6 is a diagram illustrating a state where the position a where the exposure by the exposure unit 74 starts reaches initially the position facing the primary transfer roller 93. FIG. 7 is a diagram illustrating a state where the position b on the photoconductive drum 71 reaches again the position corresponding to the primary transfer roller 93 after rotating once.

After the position a where the exposure starts passes through the position facing the primary transfer roller 93, the toner image formed after the position a is transferred to the transfer belt 91. In addition, while the position b reaches again the position corresponding to the primary transfer roller 93, a region before the position b in the rotation direction of the photoconductive drum 71 is a region where the transfer bias is not applied. Accordingly, the region c from the position a to the position b is a region that is exposed by the exposure unit 74 in a state where the transfer bias is not applied.

As illustrated in FIG. 7, if the position b where the application of the transfer bias starts rotates once, the photoconductive drum 71 applies the transfer bias to the entire surface. In other words, a region after the position b where the application of the transfer bias starts in the rotation direction of the photoconductive drum 71 is a region that is exposed by the exposure unit 74 in a state where the transfer bias is applied.

Figure 8:
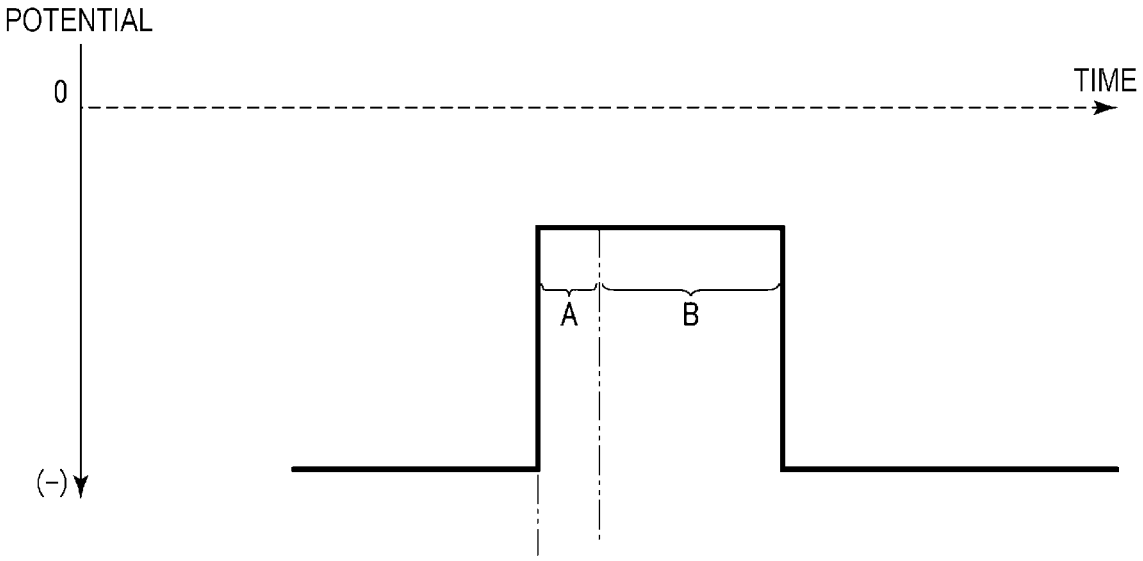
FIG. 8 is a diagram illustrating an example of a surface potential of the photoconductive drum where there is no deterioration over time.
Figure 9:
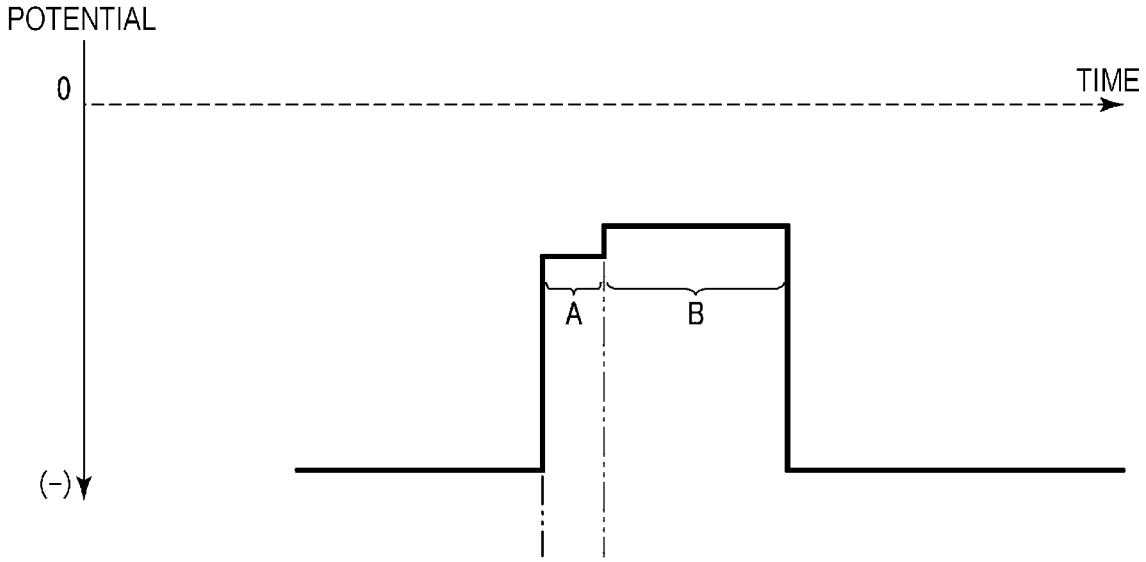
FIG. 9 is a diagram illustrating an example of the surface potential of the photoconductive drum where there is deterioration over time.
Figure 10:
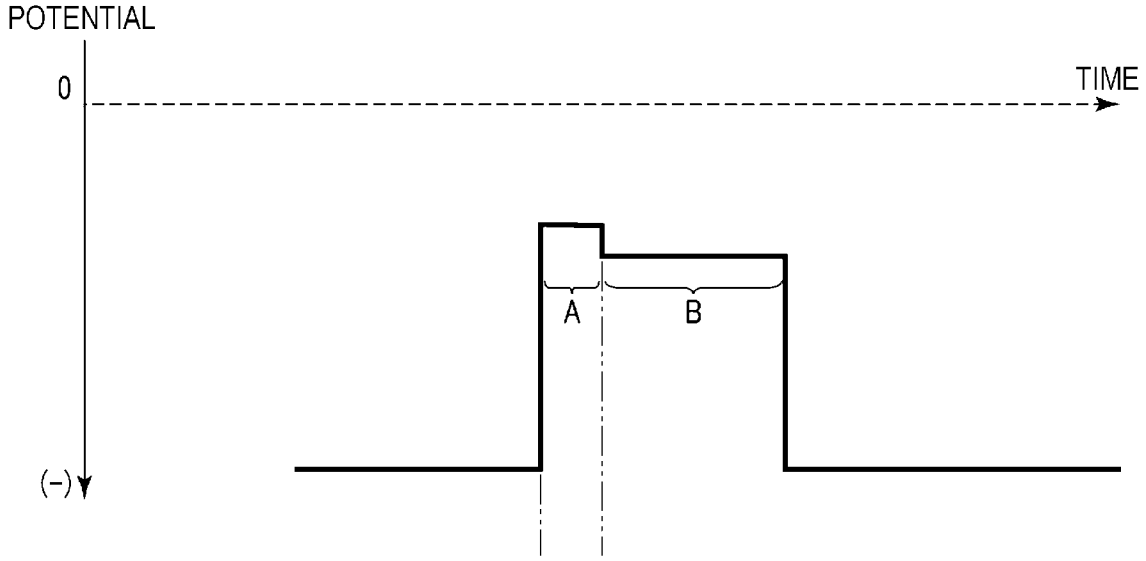
FIG. 10 is a diagram illustrating an example of the surface potential of the photoconductive drum where there is deterioration over time.

FIGS. 8 to 10 are diagrams illustrating examples of the surface potential of the photoconductive drum 71 that operates as illustrated in FIGS. 4 to 7.

In FIGS. 8 to 10, a region A is a portion that is exposed in a state where the transfer bias is not applied in the photoconductive drum 71. A region B is a portion that is exposed after the transfer bias is applied in the photoconductive drum 71 once.

In the photoconductive drum 71 where there is no deterioration over time, the surface potential does not change depending on whether or not the transfer bias is applied. Therefore, in the photoconductive drum 71 where there is no deterioration over time, there is no difference between the surface potential of the portion corresponding to the region A and the surface potential of the portion corresponding to the region B as illustrated in FIG. 8.

On the other hand, in the photoconductive drum where there is deterioration over time, the memory effect (referred to as "transfer memory") caused by the application of the transfer bias occurs on the surface. In the photoconductive drum where the transfer memory occurs, the surface potential changes between the region where the transfer bias is not applied and the region where the transfer bias is applied. Even when the photoconductive drum 71 where there is deterioration over time is charged and exposed at the same potential, there may be a potential difference between the surface potential of the portion corresponding to the region A and the surface potential of the portion corresponding to the region B.

Figure 11:
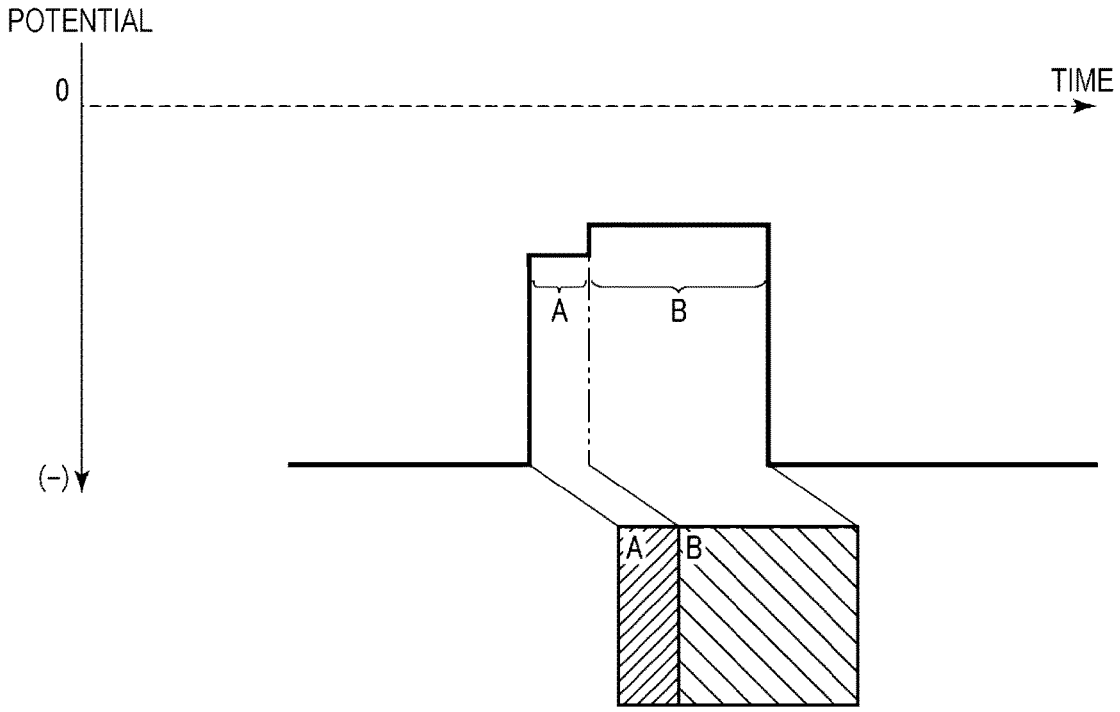
FIG. 11 is a diagram illustrating density unevenness of an image caused by a difference in surface potential of the photoconductive drum.

FIGS. 9 and 10 illustrate examples where there is a potential difference in the surface potential of the photoconductive drum 71 depending on whether or not the transfer bias is applied. In addition, FIG. 11 schematically illustrates density unevenness that occurs in the image that is transferred from the photoconductive drum 71 to the transfer belt 91 due to the surface potential difference of the photoconductive drum 71 as illustrated in FIG. 9. As illustrated in FIG. 11, the surface potential difference of the photoconductive drum 71 that occurs due to deterioration over time appears as the density unevenness in the image to be printed.

Some image forming apparatus may include a charge eraser that erases charge before charging. The image forming apparatus including the charge eraser executes charging and exposure again after erasing charge with the charge eraser. Even in the image forming apparatus including the charge eraser, the portion corresponding to the region B is charged after the transfer bias is applied once. Therefore, even in the image forming apparatus including the charge eraser, the transfer memory may occur due to the deterioration over time of the photoconductive drum.

Next, an operation of detecting deterioration of the photoconductive drum 71 in the image forming apparatus 1 according to the embodiment will be described.

The image forming apparatus 1 detects deterioration over time of the photoconductive drum 71 based on the surface potential difference of the photoconductive drum 71. In the image forming apparatus 1, the surface potential of the photoconductive drum 71 is measured by the sensor 100. The image forming apparatus 1 detects that the surface potential of the photoconductive drum 71 that is charged by the charging unit 73 changes depending on the application of the transfer bias.

Separately from an operation of actually printing an image on the printing medium P, the image forming apparatus 1 executes a deterioration detection operation of detecting the deterioration over time of the photoconductive drum 71 based on the surface potential of the photoconductive drum 71. The image forming apparatus 1 compares the surface potential of the photoconductive drum 71 if the transfer bias is not applied and the surface potential of the photoconductive drum 71 if the transfer bias is applied to each other.

Figure 12:
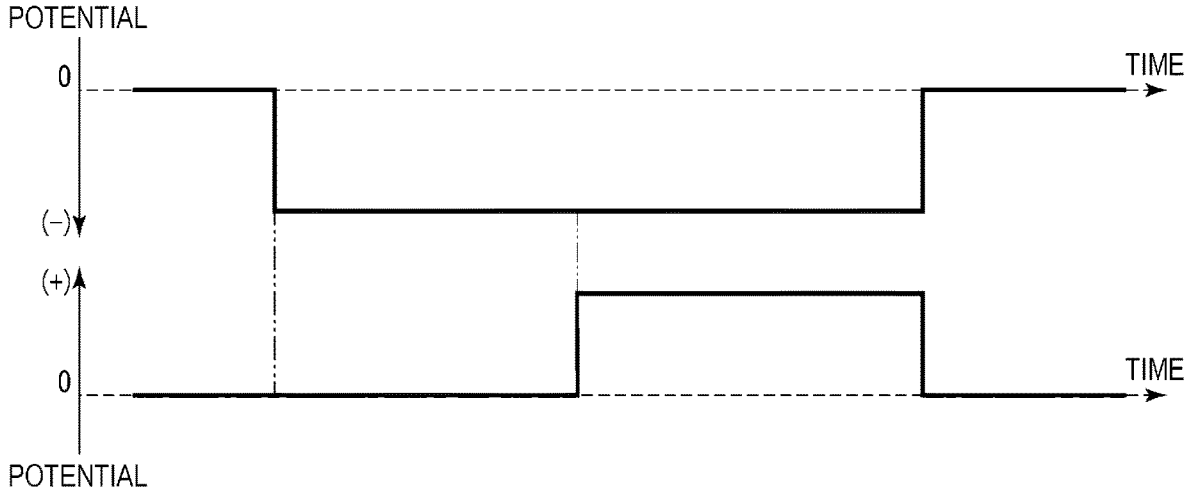
FIG. 12 is a diagram illustrating a relationship between the surface potential of the photoconductive drum where there is no deterioration over time and a charging timing and an output timing of a transfer bias.

FIG. 12 illustrates a relationship between the surface potential of the photoconductive drum where there is no deterioration over time and an output timing of the transfer bias. As illustrated in FIG. 12, in the photoconductive drum where there is no deterioration over time, the surface potential does not change depending on the application of the transfer bias.

Figure 13:
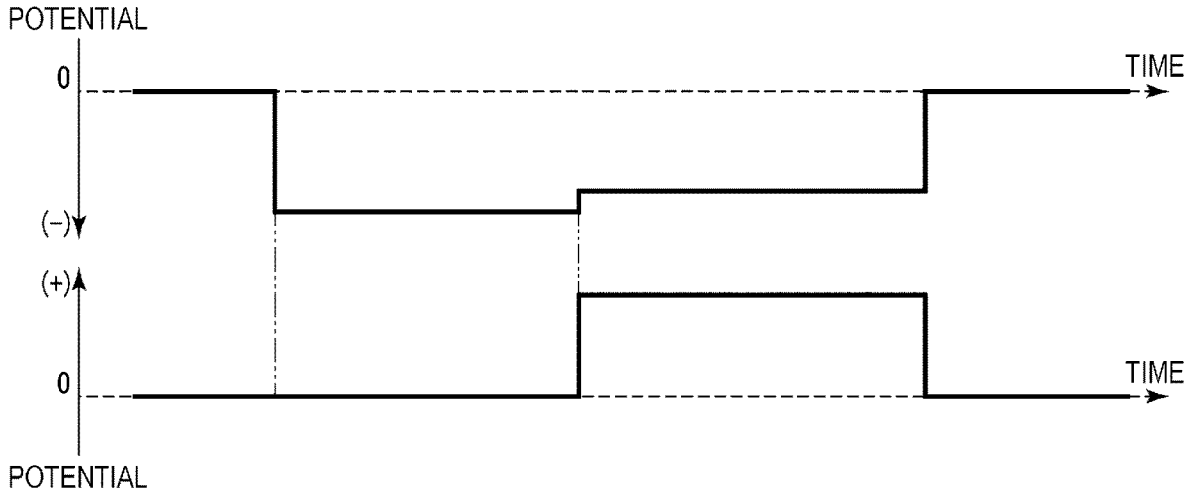
FIG. 13 is a diagram illustrating a relationship between the surface potential of the photoconductive drum where there is deterioration over time and the charging timing and the output timing of a transfer bias.
Figure 14:
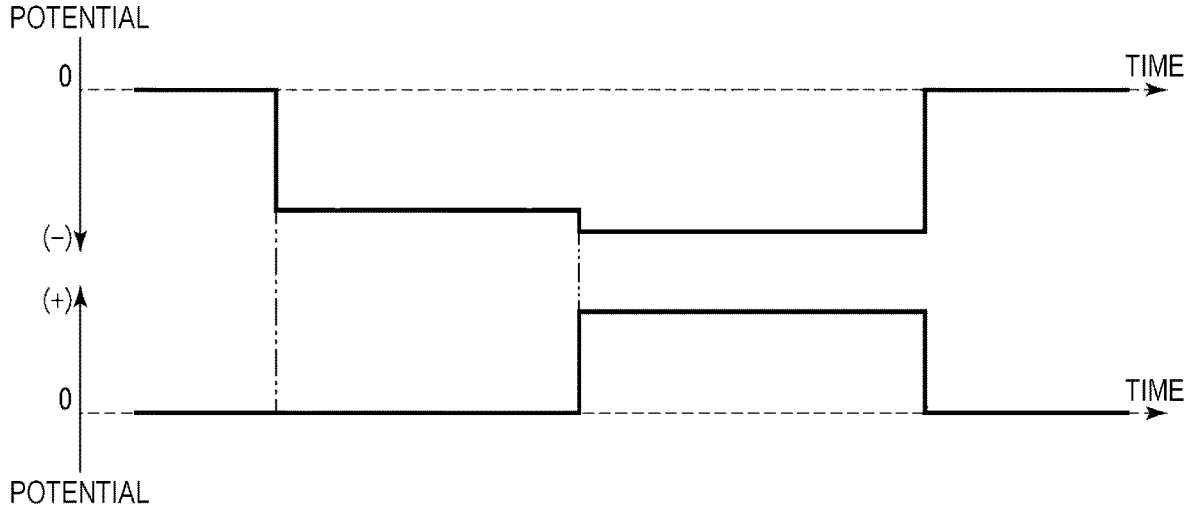
FIG. 14 is a diagram illustrating a relationship between the surface potential of the photoconductive drum where there is deterioration over time and the charging timing and the output timing of the transfer bias.

FIGS. 13 and 14 illustrate a relationship between the surface potential of the photoconductive drum where there is deterioration over time and an output timing of the transfer bias. As illustrated in FIG. 13 or 14, in the photoconductive drum 71 where the deterioration over time is accelerated, the surface potential changes if the transfer bias is applied.

The processor 131 detects deterioration of the photoconductive drum 71 based on the surface potential change caused by the application of the transfer bias illustrated in FIG. 13 or 14. The processor 131 measures the surface potential of the photoconductive drum in a period (non-application portion) where the transfer bias is not applied. The processor 131 measures the surface potential of the photoconductive drum in a period (application portion) where the transfer bias is applied. If a difference (surface potential difference) between the surface potential of the non-application portion and the surface potential of the application portion exceeds a threshold, the processor 131 detects the deterioration of the photoconductive drum.

In addition, if the deterioration of the photoconductive drum is detected, the processor 131 can change (adjust) a control value used for the application control of the transfer bias. As the control value used for the application control of the transfer bias, an output timing of the transfer bias, an applied value of the transfer bias, and the like can be changed.

Figure 15:
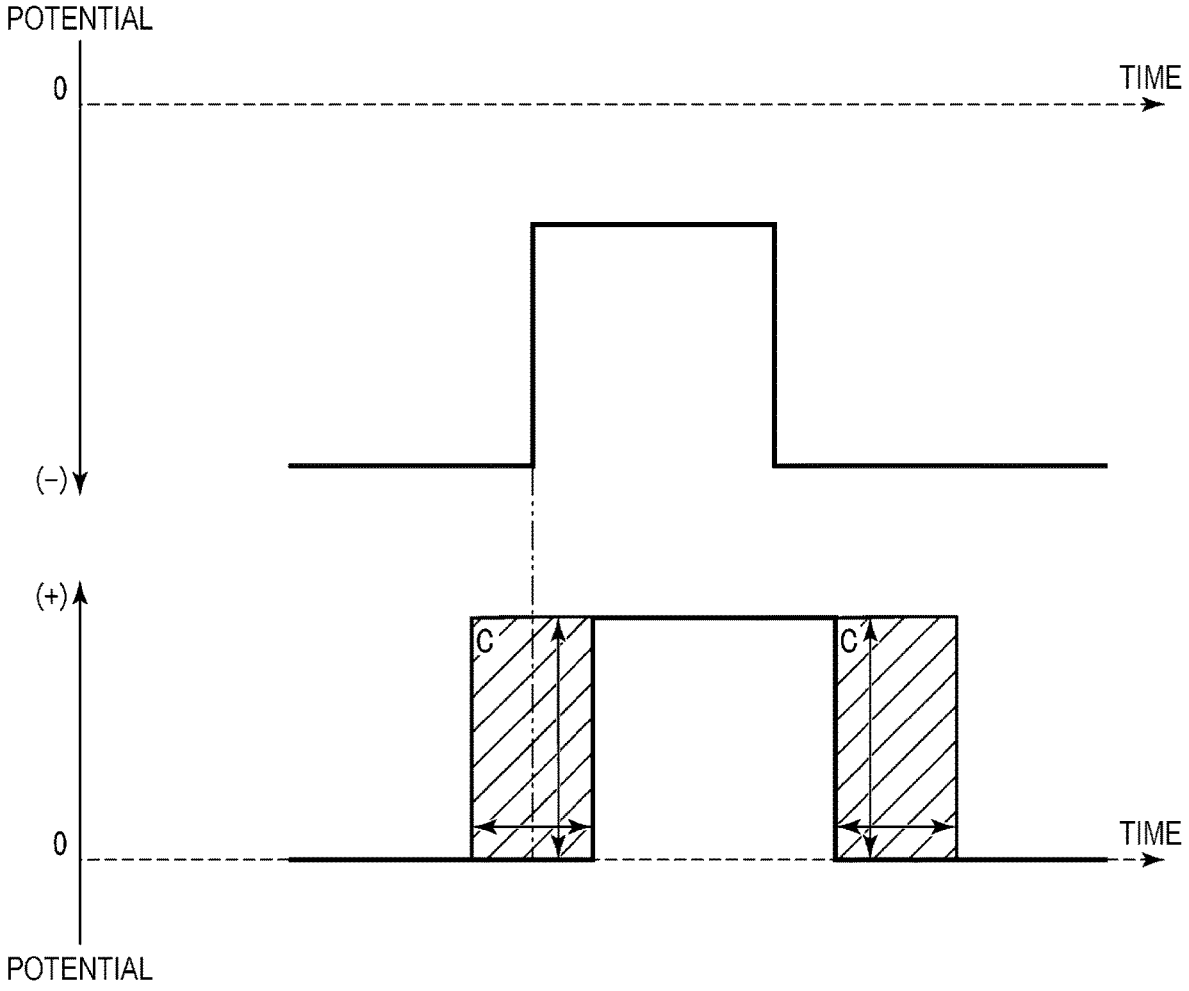
FIG. 15 is a diagram illustrating an adjusted value for a transfer bias applied to the photoconductive drum.

FIG. 15 is a diagram illustrating an adjusted value relative to the control value for applying the transfer bias to the photoconductive drum 71 in the image forming apparatus 1.

As illustrated in FIG. 15, the output timing and the applied value of the transfer bias can be changed. By changing the output timing and the applied value of the transfer bias, an oblique line portion C illustrated in FIG. 15 can be changed.

As the change in the output timing of the transfer bias, a timing at which the application of the transfer bias starts can be advanced. In addition, the timing at which the application of the transfer bias stops can be delayed. A timing at which the application of the transfer bias starts or stops can be freely set.

For example, the output timing of the transfer bias is adjusted such that the transfer bias is applied to the start position of the exposure. By applying the transfer bias to the exposure start position, the occurrence of density unevenness caused by whether or not the application of the transfer bias can be prevented.

In addition, the applied value of the transfer bias can be set in the period where the start of the application of the transfer bias is advanced and in the period where the stop of the application of the transfer bias is delayed. For example, in the period where the start of the application of the transfer bias is advanced, an applied value of the transfer bias that is applied to the transfer roller in a normal condition is a reference value. Assuming that the same applied value as the reference value is 100%, the effect of preventing density unevenness increases as the applied value of the transfer bias in the period where the start of the application of the transfer bias is advanced approaches the upper limit of 100%. On the other hand, as the applied value increases, the bias that is applied to the transfer roller increases. Therefore, the deterioration of the transfer roller may be accelerated. Accordingly, the applied value of the transfer bias in the period where the start of the application of the transfer bias is advanced can be set in consideration of the effect of preventing density unevenness and the deterioration of the transfer roller.

Next, the setting of deterioration detection for the photoconductive drum 71 in the image forming apparatus 1 according to the embodiment will be described.

Figure 16:
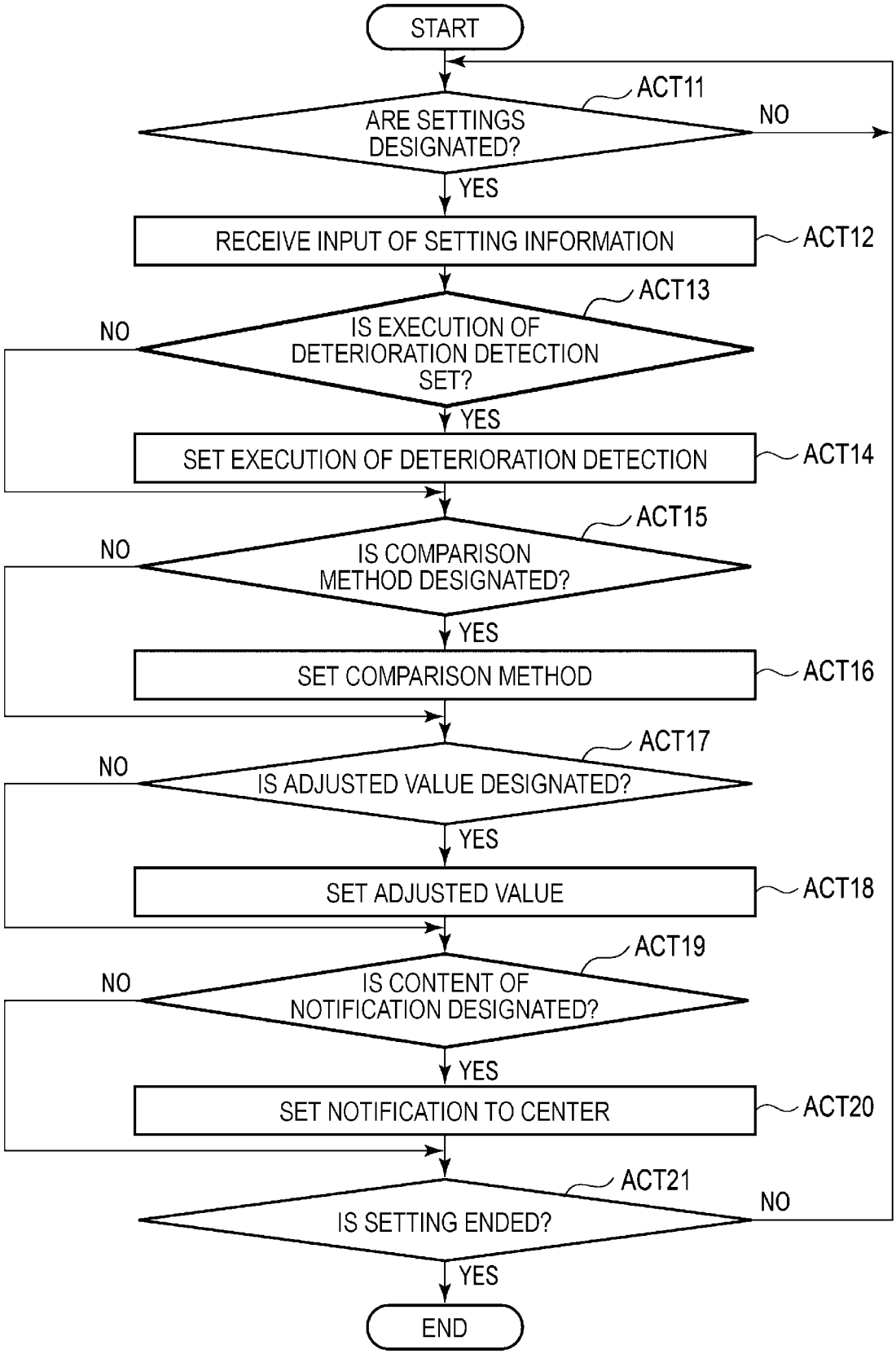
FIG. 16 is a flowchart illustrating a setting process such as deterioration detection and adjustment of the photoconductive drum.

FIG. 16 is a flowchart illustrating a setting operation of the deterioration detection for the photoconductive drum 71 in the image forming apparatus 1.

The processor 131 of the image forming apparatus 1 receives various settings relating to the deterioration detection (ACT 11). If various settings relating to the deterioration detection are designated (ACT 11, YES), the processor 131 receives an input of setting information representing the deterioration detection (ACT 12). The setting information representing the deterioration detection is stored in the auxiliary storage device 134. If the deterioration detection for the photoconductive drum starts, the processor 131 executes the deterioration detection in accordance with the setting information stored in the auxiliary storage device 134.

The processor 131 receives designation of a condition where the deterioration detection starts. If the condition where the deterioration detection starts is input (ACT 13, YES), the processor 131 stores information representing the condition where the deterioration detection starts in the auxiliary storage device 134 as the setting information (ACT 14). For example, an operator (user or manager) designates the number of images to be formed as the condition where the deterioration detection operation starts. If the number of images to be formed is designated as the condition where the deterioration detection starts, the processor 131 stores the number of images to be formed as the setting information for executing the deterioration detection.

The processor 131 receives designation of a comparison method of comparing the surface potential of the photoconductive drum to a threshold as the deterioration detection. If the comparison method to be executed is designated (ACT 15, YES), the processor 131 stores setting information representing the comparison method that is designated to be executed in the auxiliary storage device 134 (ACT 16). The processor 131 of the image forming apparatus 1 includes a plurality of comparison methods as the comparison method of the surface potential using a plurality of pre-installed programs. The processor 131 receives designation of the operator for whether or not to execute each of the executable comparison methods. For example, if the processor 131 includes four comparison methods as described below, the processor 131 receives designation for whether or not to execute each of the four comparison methods. The processor 131 stores setting information representing whether or not to execute each of the comparison methods in the auxiliary storage device 134.

The processor 131 receives designation of an adjusted value for the application control of the transfer bias to be applied if the deterioration of the photoconductive drum is detected. If the adjusted value for the application control of the transfer bias is designated (ACT 17, YES), the processor 131 stores setting information representing the designated adjusted value in the auxiliary storage device 134 (ACT 18). As the adjusted value for the application control of the transfer bias, an adjusted value for the output timing and the applied value of the transfer bias is designated.

In addition, if the deterioration of the photoconductive drum is detected, the processor 131 also receives designation of whether or not to change the application control of the transfer bias. As a result, the operator can designate the application control of the transfer bias to be automatically changed based on the adjusted value designated if the deterioration of the photoconductive drum is detected.

Further, the processor 131 receives designation of the content of notification to be notified to a center as a management apparatus if the deterioration of the photoconductive drum is detected. If the content of notification is designated (ACT 19, YES), the processor 131 stores setting information representing the designated content of notification in the auxiliary storage device 134 (ACT 20). If the deterioration of the photoconductive drum is detected, the processor 131 notifies the content of notification representing the setting information stored in the auxiliary storage device 134 to the sensor.

If the setting end is not instructed (ACT 21, NO), the processor 131 continues the above-described various settings. If the setting end is instructed (ACT 21, YES), the processor 131 ends the setting operation. In the above-described setting operation, the various setting information for executing the deterioration detection can be stored in accordance with the instruction of the operator.

Next, the deterioration detection operation of the photoconductive drum 71 in the image forming apparatus 1 according to the embodiment will be described.

Figure 17:
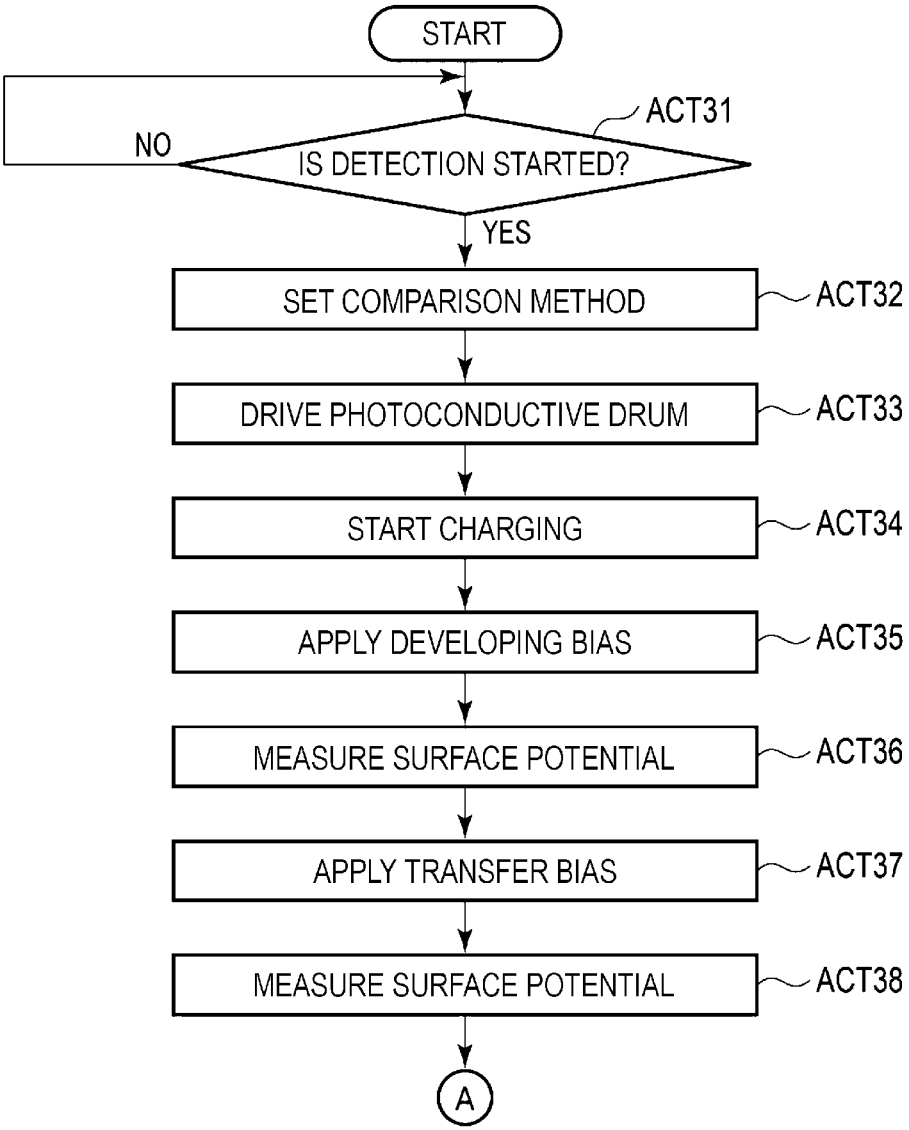
FIG. 17 is a flowchart illustrating the setting process such as deterioration detection and adjustment of the photoconductive drum.
Figure 18:
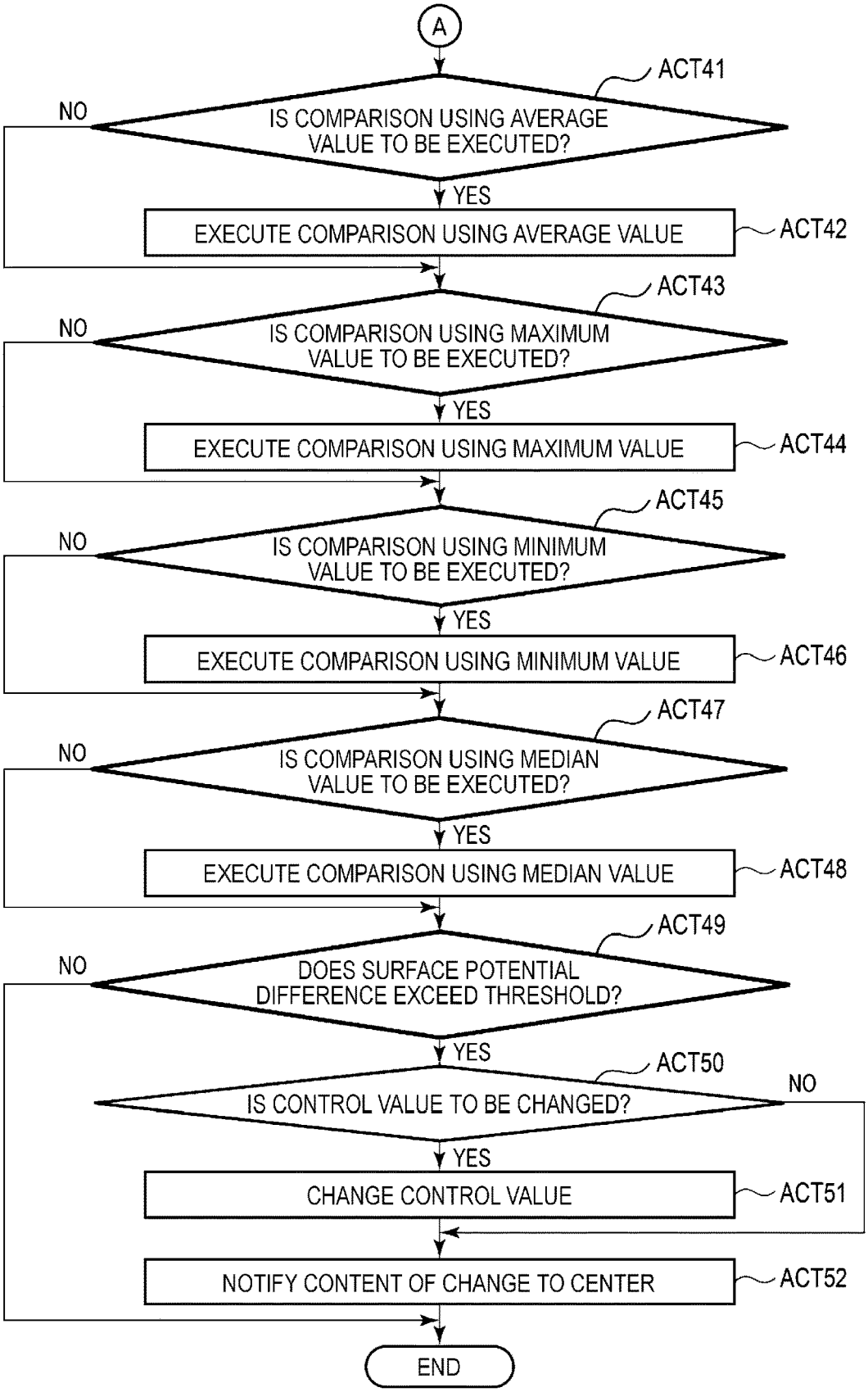
FIG. 18 is a flowchart illustrating an operation example of deterioration detection of the photoconductive drum.

FIGS. 17 and 18 are flowcharts illustrating the deterioration detection operation of the photoconductive drum 71 in the image forming apparatus 1.

The processor 131 of the image forming apparatus 1 determines whether or not to start the deterioration detection (ACT 31). The processor 131 determines the start of the deterioration detection based on the setting information stored in the auxiliary storage device 134. For example, the auxiliary storage device 134 sets the number of images to be formed as the condition where the deterioration detection starts that is the execution setting of the deterioration detection. If the number of images to be formed reaches the set number, the processor 131 starts the deterioration detection. In addition, even when the execution of the deterioration detection is instructed at any timing, the processor 131 may start the deterioration detection operation.

If the deterioration detection operation starts (ACT 31, YES), the processor 131 sets the comparison method of the surface potential for calculating the surface potential difference (ACT 32). Based on the setting information stored in the auxiliary storage device 134, the processor 131 specifies the comparison method that is set to be executed from the comparison methods. One comparison method or a plurality of comparison methods may be executed.

If the deterioration detection operation starts, the processor 131 drives the motor 30 to rotate the photoconductive drum 71 that is a target of the deterioration detection (ACT 33). If the deterioration detection is executed on the photoconductive drums, the processor 131 executes the deterioration detection on each of the photoconductive drums. The processor 131 may execute the deterioration detection operation on the photoconductive drums at the same time.

If the photoconductive drum 71 is rotated, the processor 131 causes the charging unit 73 corresponding to the rotating photoconductive drum 71 to start charging the photoconductive drum 71 (ACT 34). The processor 131 causes the charging unit 73 to uniformly charge the surface of the photoconductive drum 71 at a predetermined potential. The processor 131 causes the charging unit 73 to continuously execute a charging operation at a given value during the measurement of the surface potential of the photoconductive drum 71.

In addition, the processor 131 applies the developing bias to the developing unit 75 in order to inhibit the developer from being transferred to the surface of the photoconductive drum 71 (ACT 35). If the rotating photoconductive drum 71 is charged, the developer in the developing unit 75 is transferred to the surface of the photoconductive drum. Therefore, the processor 131 applies the developing bias in order to inhibit the supply of the developer to the photoconductive drum. The image forming apparatus 1 may execute a control other than the application of the developing bias such that the supply of the developer to the photoconductive drum is inhibited.

After the start of charging, the processor 131 causes the sensor 100 to measure the surface potential of the photoconductive drum 71 in a state where the photoconductive drum is continuously charged at a predetermined potential without applying the transfer bias (ACT 36). The processor 131 causes the sensor 100 to measure the surface potential of the photoconductive drum in the period where the transfer bias is not applied. For example, in order to specify the first surface potential, the processor 131 measures the surface potential of the photoconductive drum at a predetermined interval in a predetermined sampling period where the transfer bias is not applied. In addition, a method (for example, the number of times of measurement or the sampling period) of measuring the surface potential to specify the first surface potential may be set for each of the comparison methods.

After the start of charging, the processor 131 measures the output timing of the transfer bias. If a predetermined output timing is reached, the processor 131 causes the transfer mechanism 42 to apply a predetermined potential as the transfer bias (ACT 37). If the transfer bias is applied, the processor 131 causes the sensor 100 to measure the surface potential of the photoconductive drum 71 in the period where the transfer bias is applied (ACT 38). For example, in order to specify the second surface potential, the processor 131 measures the surface potential of the photoconductive drum 71 at a predetermined interval in a predetermined sampling period where the transfer bias is applied. In addition, a method (for example, the number of times of measurement or the sampling period) of measuring the surface potential to specify the second surface potential may be set for each of the comparison methods.

The processor 131 holds the charging potential, the developing bias, and the transfer bias at fixed values during the measurement of the surface potential. In this case, each of the charging potential, the developing bias, and the transfer bias may be any set value designated by a user or a manager.

After measuring the surface potential in the period where the transfer bias is not applied and the surface potential in the period where the transfer bias is applied, the processor 131 executes the comparison using the set comparison method.

If the comparison is executed using the average value of measured values as a first comparison method (ACT 41, YES), the processor 131 calculates the average value of surface potentials measured in the period where the transfer bias is not applied. The processor 131 calculates the average value of surface potentials measured in the period where the transfer bias is not applied as the first surface potential. The processor 131 calculates the average value of surface potentials measured by the sensor 100 in the period where the transfer bias is applied as the second surface potential.

After calculating the first surface potential and the second surface potential as the average values, the processor 131 calculates a difference (surface potential difference) between the calculated first surface potential and the calculated second surface potential. After calculating the surface potential difference, the processor 131 compares the calculated surface potential difference to a threshold (ACT 42). The threshold may be set for each of the comparison methods. If the threshold for the first comparison method is set, the processor 131 compares the threshold for the first comparison method and the surface potential difference to each other.

If the comparison is executed using the maximum value of measured values as a second comparison method (ACT 43, YES), the processor 131 specifies the maximum value of surface potentials measured in the period where the transfer bias is not applied as the first surface potential. In addition, if the comparison is executed using the second comparison method, the processor 131 specifies the maximum value of surface potentials measured by the sensor 100 in the period where the transfer bias is applied as the second surface potential.

After specifying the first surface potential and the second surface potential as the maximum values, the processor 131 calculates a difference (surface potential difference) between the specified first surface potential and the specified second surface potential. After calculating the surface potential difference, the processor 131 compares the calculated surface potential difference to a threshold (ACT 44). If the threshold for the second comparison method is set, the processor 131 compares the calculated surface potential difference and the threshold for the second comparison method to each other.

If the comparison is executed using the minimum value of measured values as a third comparison method (ACT 45, YES), the processor 131 specifies the minimum value of surface potentials measured in the period where the transfer bias is not applied as the first surface potential. In addition, if the comparison is executed using the third comparison method, the processor 131 specifies the minimum value of surface potentials measured by the sensor 100 in the period where the transfer bias is applied as the second surface potential.

After specifying the first surface potential and the second surface potential as the minimum values, the processor 131 calculates a difference (surface potential difference) between the specified first surface potential and the specified second surface potential. After calculating the surface potential difference, the processor 131 compares the calculated surface potential difference to a threshold (ACT 46). If the threshold for the third comparison method is set, the processor 131 compares the calculated surface potential difference and the threshold for the third comparison method to each other.

If the comparison is executed using the median value of measured values as a fourth comparison method (ACT 47, YES), the processor 131 specifies the median value of surface potentials measured multiple times in the period where the transfer bias is not applied as the first surface potential. In addition, if the comparison is executed using the fourth comparison method, the processor 131 specifies the median value of surface potentials measured by the sensor 100 multiple times in the period where the transfer bias is applied as the second surface potential.

After specifying the first surface potential and the second surface potential as the median values, the processor 131 calculates a difference (surface potential difference) between the specified first surface potential and the specified second surface potential. After calculating the surface potential difference, the processor 131 compares the calculated surface potential difference to a threshold (ACT 48). If the threshold for the fourth comparison method is set, the processor 131 compares the calculated surface potential difference and the threshold for the fourth comparison method to each other.

If the comparison is executed using the set comparison method, the processor 131 determines whether or not the surface potential difference exceeds the threshold (ACT 49). If a plurality of comparison methods are set, the processor 131 determines whether or not the surface potential difference exceeds the threshold in any one of the comparison methods.

If the surface potential difference exceeds the threshold (ACT 49, NO), the processor 131 ends the deterioration detection operation.

If the surface potential difference exceeds the threshold (ACT 49, YES), the processor 131 determines whether or not to change (adjust) the control value used for the application control of the transfer bias (ACT 50). If the control value is not changed (ACT 50, NO), the processor 131 causes the communication interface 12 to notify the management apparatus that the surface potential difference exceeds the threshold (ACT 52). If the surface potential difference exceeds the threshold, the processor 131 may store the fact that the surface potential difference exceeds the threshold in the auxiliary storage device 134.

If the processor 131 determines to change the control value used for the application control of the transfer bias (ACT 50, YES), the processor 131 changes the control value based on the preset setting information (ACT 51). As described above, the processor 131 changes the output timing of the transfer bias and the applied value of the transfer bias in accordance with the setting information stored in the auxiliary storage device 134. In addition, the processor 131 may change the control value based on the adjusted value designated by the user or the manager.

If the control value used for the application control of the transfer bias is changed, the processor 131 notifies the management apparatus of the fact that the surface potential difference exceeds the threshold, the content of change of the control value, and the like (ACT 52). The processor 131 may notify not only the content of change of the control value but also the time of use of the photoconductive drum, the number of images to be formed by the photoconductive drum, and the like to the management apparatus. If this content is notified to the management apparatus, the processor 131 ends the deterioration detection for the photoconductive drum 71 as a target.

The processor 131 executes the above-described deterioration detection operation on each of the photoconductive drums 71 mounted on the image forming apparatus 1. For example, if the deterioration operation on one photoconductive drum ends, the processor 131 executes the deterioration detection on another photoconductive drum where the deterioration detection is not executed. For example, if image forming stations corresponding to four colors are provided, the processor 131 executes the above-described deterioration detection operation on the photoconductive drums of the four image forming stations.

As described above, the image forming apparatus detects the deterioration over time of the photoconductive drum based on the difference between the surface potential in the period where the transfer bias is not applied and the surface potential in the period where the transfer bias is applied. In addition, by starting charging and starting the application of the developing bias, the image forming apparatus specifies the surface potentials and the surface potential difference in a state where the supply of the developer to the photoconductive drum is stopped.

As a result, the image forming apparatus according to the embodiment can detect the deterioration over time of the photoconductive drum while reducing the deterioration of the developer. In addition, if the deterioration over time of the photoconductive drum is detected, the image forming apparatus according to the embodiment can prevent density unevenness or the like by changing the application control of the transfer bias.

While certain embodiments have been described, these embodiments have been presented by way of example only, and are not intended to limit the scope of the invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

an image carrier;

a charger configured to charge the image carrier;

an exposure component configured to form an electrostatic latent image on the image carrier;

a developing component configured to supply a developer to the image carrier;

a transfer device configured to apply a transfer bias to transfer a developer image from the image carrier to a medium, the developer image being formed by developing the electrostatic latent image on the image carrier with the developing component;

a sensor configured to measure a surface potential on the image carrier; and a processor configured to compare a surface potential difference between a first surface potential and a second surface potential of the image carrier to a threshold to detect that a surface potential difference exceeding the threshold is generated in the image carrier in a state where the supply of the developer from the developing component to the image carrier is inhibited, the first surface potential being a surface potential of the image carrier to which the transfer bias measured by the sensor is not applied, and the second surface potential being a surface potential of the image carrier to which the transfer bias is applied.

2. The image forming apparatus according to claim 1, wherein if the processor detects that a surface potential difference exceeding the threshold is generated in the image carrier, the processor executes a control such that the transfer bias is applied.

3. The image forming apparatus according to claim 1, further comprising:

a memory configured to store setting information representing a condition where an operation of detecting deterioration of the image carrier starts, wherein if the condition represented by the setting information stored in the memory is satisfied, the processor executes an operation of detecting that a surface potential difference exceeding the threshold is generated in the image carrier.

4. The image forming apparatus according to claim 1, wherein the processor sets, as the first surface potential, an average value of surface potentials of the image carrier that are measured by the sensor multiple times in a period where the transfer bias is not applied, sets, as the second surface potential, an average value of surface potentials of the image carrier that are measured by the sensor multiple times in a period where the transfer bias is applied, and compares a surface potential difference between the first surface potential and the second surface potential to a threshold.

5. The image forming apparatus according to claim 1, wherein the processor sets, as the first surface potential, a maximum value of surface potentials of the image carrier that are measured by the sensor multiple times in a period where the transfer bias is not applied, sets, as the second surface potential, a maximum value of surface potentials of the image carrier that are measured by the sensor multiple times in a period where the transfer bias is applied, and compares a surface potential difference between the first surface potential and the second surface potential to a threshold.

6. The image forming apparatus according to claim 1, wherein the processor sets, as the first surface potential, a minimum value of surface potentials of the image carrier that are measured by the sensor multiple times in a period where the transfer bias is not applied, sets, as the second surface potential, a minimum value of surface potentials of the image carrier that are measured by the sensor multiple times in a period where the transfer bias is applied, and compares a surface potential difference between the first surface potential and the second surface potential to a threshold.

7. The image forming apparatus according to claim 1, wherein the processor sets, as the first surface potential, a median value of surface potentials of the image carrier that are measured by the sensor multiple times in a period where the transfer bias is not applied, sets, as the second surface potential, a median value of surface potentials of the image carrier that are measured by the sensor multiple times in a period where the transfer bias is applied, and compares a surface potential difference between the first surface potential and the second surface potential to a threshold.

8. The image forming apparatus according to claim 1, further comprising:

a memory configured to store setting information representing a plurality of comparison methods for specifying the surface potential difference, wherein the processor specifies the surface potential difference based on a comparison method selected from the comparison methods stored in the memory as the setting information.

9. The image forming apparatus according to claim 1, further comprising:

a memory configured to store a set value for adjusting an application timing and an applied value of the transfer bias if a surface potential difference exceeding the threshold is generated in the image carrier, wherein if the processor detects that a surface potential difference exceeding the threshold is generated in the image carrier, the processor adjusts the application timing and the applied value of the transfer bias based on the set value stored in the memory.

10. The image forming apparatus according to claim 1, further comprising:

a communication interface configured to communicate with a management apparatus, wherein if the processor detects that a surface potential difference exceeding the threshold is generated in the image carrier, the processor causes the communication interface to notify the management apparatus of the surface potential difference generated in the image carrier.

11. A method for operating an image forming apparatus, comprising:

charging an image carrier;

forming an electrostatic latent image on the image carrier;

supplying a developer to the image carrier;

applying a transfer bias to transfer a developer image from the image carrier to a medium, the developer image being formed by developing the electrostatic latent image on the image carrier;

measuring a surface potential on the image carrier; and comparing a surface potential difference between a first surface potential and a second surface potential of the image carrier to a threshold to detect that a surface potential difference exceeding the threshold is generated in the image carrier in a state where the supply of the developer from a developing component to the image carrier is inhibited, the first surface potential being a surface potential of the image carrier to which the transfer bias measured by the sensor is not applied, and the second surface potential being a surface potential of the image carrier to which the transfer bias is applied.

12. The method according to claim 11, further comprising:

if a surface potential difference exceeding the threshold is generated in the image carrier is detected, executing a control such that the transfer bias is applied.

13. The method according to claim 11, further comprising:

storing setting information representing a condition where an operation of detecting deterioration of the image carrier starts; and if the condition represented by the setting information stored in the memory is satisfied, executing an operation of detecting that a surface potential difference exceeding the threshold is generated in the image carrier.

14. The method according to claim 11, further comprising:

setting, as the first surface potential, an average value of surface potentials of the image carrier that are measured multiple times in a period where the transfer bias is not applied;

setting, as the second surface potential, an average value of surface potentials of the image carrier that are measured multiple times in a period where the transfer bias is applied; and comparing a surface potential difference between the first surface potential and the second surface potential to a threshold.

15. The method according to claim 11, further comprising:

setting, as the first surface potential, a maximum value of surface potentials of the image carrier that are measured multiple times in a period where the transfer bias is not applied;

setting, as the second surface potential, a maximum value of surface potentials of the image carrier that are measured multiple times in a period where the transfer bias is applied; and comparing a surface potential difference between the first surface potential and the second surface potential to a threshold.

16. The method according to claim 11, further comprising:

setting, as the first surface potential, a minimum value of surface potentials of the image carrier that are measured multiple times in a period where the transfer bias is not applied;

setting, as the second surface potential, a minimum value of surface potentials of the image carrier that are measured multiple times in a period where the transfer bias is applied; and comparing a surface potential difference between the first surface potential and the second surface potential to a threshold.

17. The method according to claim 11, further comprising:

setting, as the first surface potential, a median value of surface potentials of the image carrier that are measured multiple times in a period where the transfer bias is not applied;

setting, as the second surface potential, a median value of surface potentials of the image carrier that are measured multiple times in a period where the transfer bias is applied; and comparing a surface potential difference between the first surface potential and the second surface potential to a threshold.

18. The method according to claim 11, further comprising:

storing setting information representing a plurality of comparison methods for specifying the surface potential difference; and specifying the surface potential difference based on a comparison method selected from the comparison methods stored as the setting information.

19. The method according to claim 11, further comprising:

storing a set value for adjusting an application timing and an applied value of the transfer bias if a surface potential difference exceeding the threshold is generated in the image carrier; and if a surface potential difference exceeding the threshold is generated in the image carrier is detected, adjusting the application timing and the applied value of the transfer bias based on the set value stored.

20. The method according to claim 11, further comprising:

communicating with a management apparatus; and if a surface potential difference exceeding the threshold is generated in the image carrier is detected, notifying the management apparatus of the surface potential difference generated in the image carrier.

* * * * *